US005645742A

United States Patent [19]

Schmidt et al.

[11] Patent Number: 5,645,742

[45] Date of Patent: Jul. 8, 1997

[54] GLOW PLUG WITH ZIRCONIUM DIOXIDE COATING AND NICRALY ADHESIVE LAYER

[75] Inventors: Gabriele Schmidt; Karl-Heinz Schmidt, both of Ludwigsburg; Hans Delesky, Sachsenheim, all of Germany

[73] Assignee: Beru Ruprecht GmbH & Co. KG, Ludwigsburg, Germany

[21] Appl. No.: 448,344

[22] PCT Filed: Oct. 12, 1994

[86] PCT No.: PCT/EP94/03367

§ 371 Date: Jun. 12, 1995

§ 102(e) Date: Jun. 12, 1995

[87] PCT Pub. No.: WO95/10736

PCT Pub. Date: Apr. 20, 1995

[30] Foreign Application Priority Data

Dec. 10, 1993 [DE] Germany ..... 43 34 771.1

[51] Int. Cl.[6] ..... F23Q 7/00

[52] U.S. Cl. ..... 219/270; 123/145 A; 361/266; 428/633

[58] Field of Search ..... 219/270, 267, 219/264, 260, 544; 123/145 A; 361/264–266; 428/633; 338/22 R, 225 D

[56] References Cited

U.S. PATENT DOCUMENTS

| | | | |
|---|---|---|---|
| 4,055,705 | 10/1977 | Stecura et al. | 428/633 |
| 4,217,138 | 8/1980 | Ito | 219/270 |
| 4,485,151 | 11/1984 | Stecura | 428/633 |

FOREIGN PATENT DOCUMENTS

| | | |
|---|---|---|
| 8815005 | 5/1990 | Germany . |
| 61-107013 | 5/1986 | Japan . |

*Primary Examiner*—John A. Jeffery

*Attorney, Agent, or Firm*—Sixbey, Friedman, Leedom & Ferguson, PC

[57] ABSTRACT

Glow plug with a heating rod formed of an inner pole (2) and a glow tube (5) in which there is heating element (3) which is electrically connected to the inner pole (2). At least in the area of its tip, the glow tube (5) is provided with a coating (7) of ceramic material, especially yttrium-stabilized zirconium dioxide which has a subsurface or adhesive layer (6) of NiCrAlY which is directly provided on the glow tube (5).

7 Claims, 1 Drawing Sheet

GLOW PLUG WITH ZIRCONIUM DIOXIDE COATING AND NICRALY ADHESIVE LAYER

The invention relates to a glow plug with a heating rod consisting of an inner pole and a glow tube in which there is a heating element which is electrically connected to the inner pole.

A glow plug of this type which is known for example from published German Patent Application 41 33 338, can be made in the form of a rod glow plug and can be used as a starting aid for an air-compressing internal combustion engine.

Glow plugs are moreover used for ignition support in heaters.

The problem in conventional known glow plugs of this type is that they do not satisfy future requirements for a short heat-up time, or shortening of the heat-up time must be achieved at the cost of reducing the service life of the glow plug.

The problem underlying the invention therefore consists in devising a glow plug of the aforementioned type which has a short heat-up time without adversely affecting its service life.

This problem is solved according to the invention by providing the glow plug at least in the area of its tip with a coating of ceramic material.

The ceramic coating according to the invention acts as a surface protection of the glow tube so that its wall thickness can be greatly reduced. The resulting lower mass leads to the glow plug according to the invention having a short heat-up time, i.e. rapid heat-up, by which faster starting readiness can be achieved in diesel motor vehicles with engines which are equipped with these glow plugs. In this case the extremely fast heat-up time is achieved without adversely affecting the service life of the glow plug.

The version according to the invention furthermore has the advantage that scaling off of the material of the glow tube with the short heat-up times, longer afterglow and high temperatures is prevented, by which it becomes possible to use glow tubes of a material of lower costs. This cost savings moreover arises due to the fact that the glow tube can have smaller wall thicknesses.

The coating provided according to the invention furthermore satisfies the requirement which exists in heating devices that the glowing tip of the heating rod must be electrically insulated from the glow current.

Finally, relative mass freedom of the tip of the heating rod or the heating rod itself for two-pole glow plugs, for example when installed in a protective tube in heaters, is achieved.

Below, one especially preferred embodiment of the invention is detailed using the pertinent drawing.

DETAILED DESCRIPTION OF THE INVENTION

Figure 1:
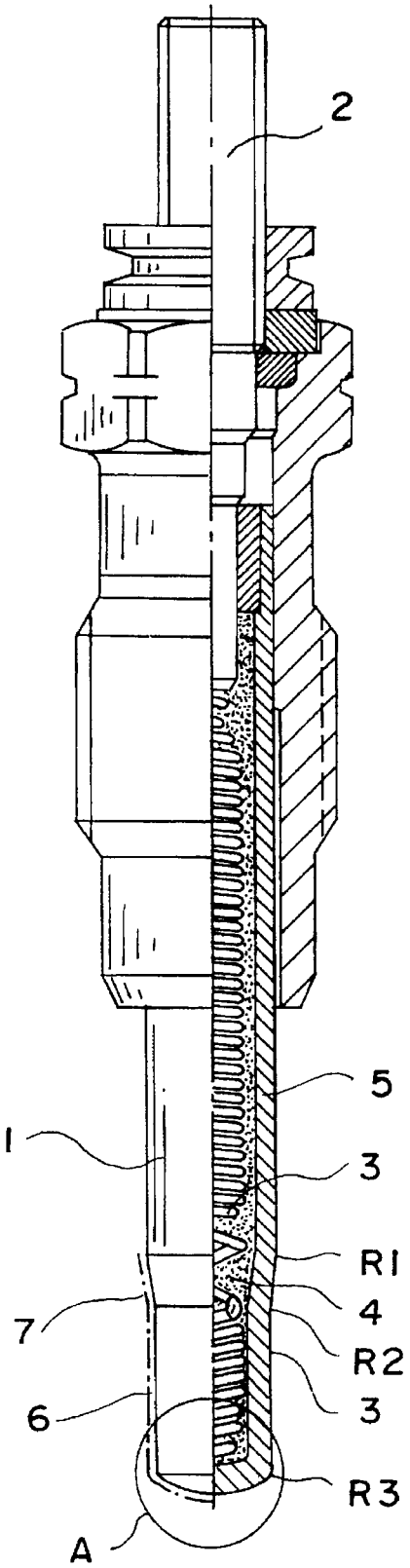
FIG. 1 is a partial cross-sectional view of a glow plug in accordance with a preferred embodiment of the invention.
Figure 1A:
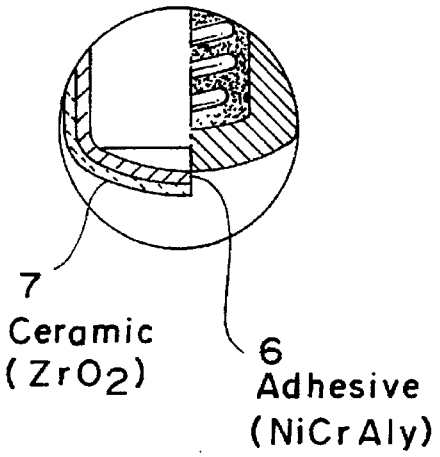
FIG. 1A is an enlarged view of the encircled detail A of FIG. 1.

The embodiment of the glow plug according to the invention shown in the drawing comprises a housing in which heating rod 1 is located which consists of inner pole

2 for connection to the electric power supply and glow tube 5 in which heating element 3 is located which is electrically connected to inner pole 2. Heating element 3 which can consist of a heating and control coil, of which the control coil is connected to inner pole 2, is embedded in MgO filler 4 in glow tube 5.

Glow tube 5 has at least on its tip, a coating 6, 7 of ceramic material which consists in the embodiment shown in the drawing of subsurface or adhesive layer 6 of NiCrAlY, especially of Ni 22Cr 10Al 1Y or similar material and actual ceramic cover layer 7 which consists preferably of yttrium-stabilized zirconium dioxide mixed with Ni Cr Al Y. The mixing ratio between the zirconium dioxide and the admixtures is between 10 and 80% for ZrO2, especially 50:50.

Adhesive layer 6 which is applied directly to glow tube 5 has a thickness between 10 and 50 microns, especially between 20 and 30 microns. Cover layer 7 is provided on adhesive layer 6.

In a design of this type glow tube 5 can consist of the alloys conventionally used to date, for example, Inconel 600 or 601, however with a low wall thickness over its entire length or on its tip or of another especially more cost-favorable alloy.

For a thinner wall of glow tube 5 more rapid heat transfer from heating element 3 to the glow tube surface is achieved, glow tube 5 moreover being protected against scaling.

To ensure adequate adhesion of the coating over the entire service life of the glow plug, a suitable heating rod or glow tube form is provided with a geometry in which edges, corners, and sharp transitions are prevented and rounded off. In the drawing R1 designates a site on which there is no coating. When the entire tip of the heating rod is coated, between R1 and R2 there is a radius of roughly 3–5 mm. Radius R3 can be conversely only roughly 1 to 2 mm.

Based on the possible lower wall thickness of glow tube 5 and the achieved uniform heat-up behavior the power consumption of the glow plug can be greatly reduced; this protects heating element 3. In this case lower temperatures on the end of the heating rod are possible on the basis of the achieved larger surface and there is a similarity to ceramic plugs.

We claim:

1. Glow plug with a heating rod comprised of an inner pole and a glow tube in which there is a heating element which is electrically connected to the inner pole, the glow plug, at least in a tip area thereof, being provided with a coating of ceramic material, wherein an adhesive layer of Ni Cr Al Y is formed on the glow tube and the coating of ceramic material is formed of a cover layer of yttrium-stabilized zirconium dioxide provided on adhesive layer.

2. Glow plug according to claim 1, wherein Ni Cr Al Y is added to the zirconium dioxide.

3. Glow plug according to claim 2, wherein the proportion of ZrO2 is between 10 and 80%.

4. Glow plug according to claim 3, wherein said proportion of $ZrO_2$ is 50%.

5. Glow plug according to claim 1, wherein the adhesive layer has a thickness between 10 and 50 microns.

6. Glow plug according to claim 5, wherein the thickness of adhesive layer is between 20 and 30 microns.

7. Glow plug according to claim 1, wherein the glow tube is free of corners, edges and other sharp transitions.

* * * * *